United States Patent [19]

Moreau

[11] 4,409,754

[45] Oct. 18, 1983

[54] SOFT DOLL HEAD WITH SLEEPING EYES

[76] Inventor: Claude R. M. Moreau, 8506 60th Ave., Elmhurst, N.Y. 11373

[21] Appl. No.: 257,229

[22] Filed: Apr. 24, 1981

Related U.S. Application Data

[63] Continuation of Ser. No. 86,584, Oct. 19, 1979.

[51] Int. Cl.[3] ..... A63H 3/40

[52] U.S. Cl. ..... 46/169 A

[58] Field of Search ..... 46/156, 166, 167, 168, 46/169 R, 169 A, 169 B

[56] References Cited

U.S. PATENT DOCUMENTS 1,800,711 4/1931 Wilhelm ..... 46/169 R 3,058,262 10/1962 Swedlin ..... 46/169 A 3,432,581 3/1969 Rosen ..... 46/156 X

FOREIGN PATENT DOCUMENTS 821529 10/1959 United Kingdom ..... 46/156

*Primary Examiner*—F. Barry Shay

*Attorney, Agent, or Firm*—Jacobs & Jacobs

[57] ABSTRACT

A doll head comprises a soft core, such as foam rubber, with a pair of sleeping eye modules therein, an outer covering through which the eyes peer out and an intermediary member having annular parts joined by an intermediate nose portion to form a mask-like member within the outer covering for securing the eye modules to said covering and in place relative to each other.

5 Claims, 5 Drawing Figures

FIG. 1
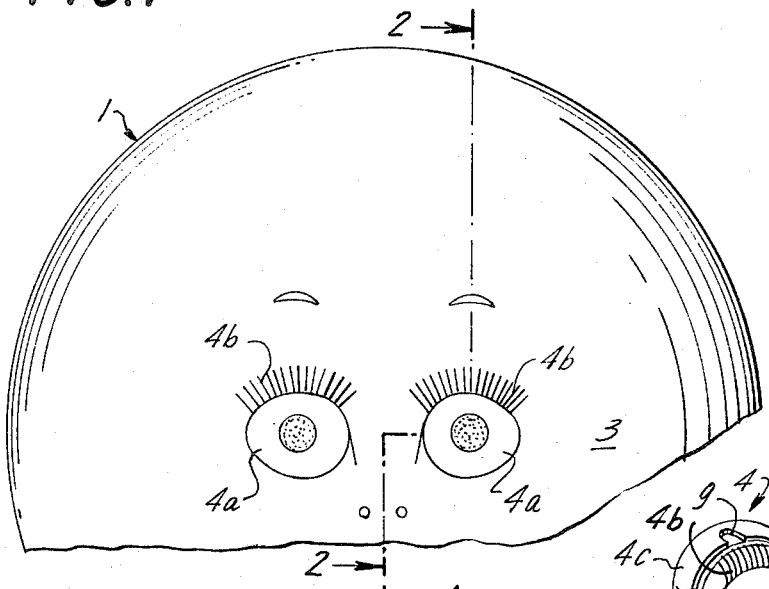
FIG. 4
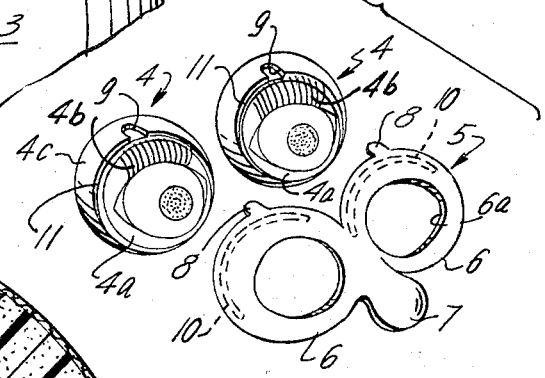
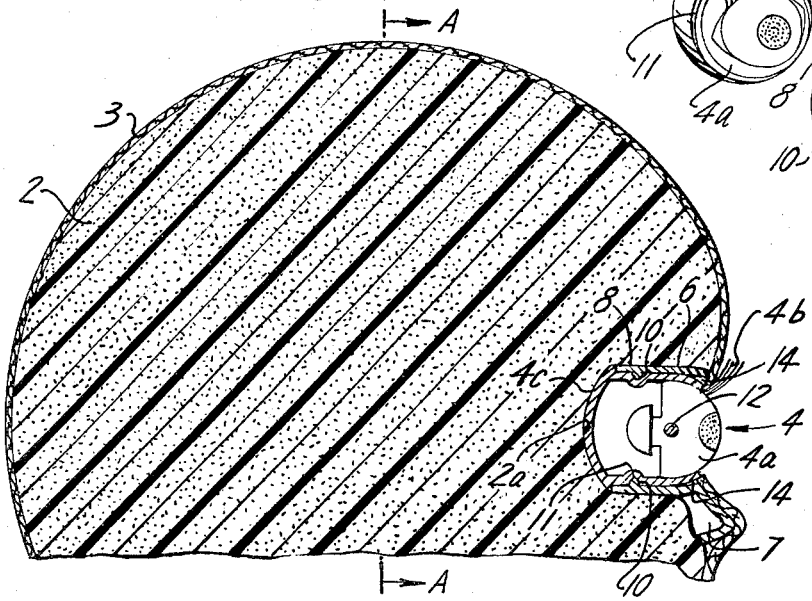
FIG. 2
FIG. 3A
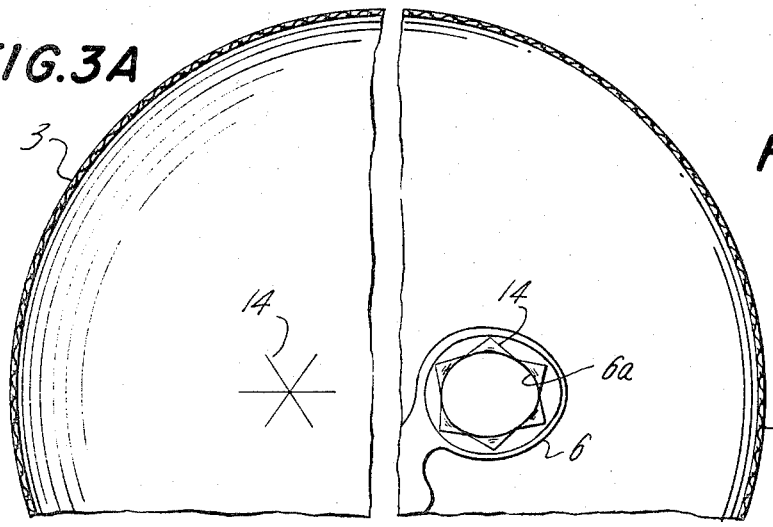
FIG. 3B

SOFT DOLL HEAD WITH SLEEPING EYES

CROSS REFERENCE

This is a continuation, of Serial No. 86,584 filed 10/19/79.

The present invention relates to a head for a soft doll, and in particular to a head for a soft doll having "sleeping" eyes.

Heretofore, dolls with "sleeping" eyes, i.e. eyes that close when the doll is placed in a horizontal position, have been limited to dolls having "hard" heads. Such dolls originally were made with china or porcelain heads, and more recently the heads of such dolls have been made of plastic material. A wide number of other hard materials have been used.

In order to provide the dolls with sleeping eyes, the technique heretofore has been simply to cut two eyeholes in the hard head and to mount a pair of sleeping eye modules in the eyeholes, the modules being held in place with tape or similar adhesive means, or molded together with the head.

Until now, it has not been possible to provide a doll having a soft head with sleeping eyes. Such dolls are normally made with an outer fabric covering onto which the face is painted or otherwise applied. The fabric is too flimsy to support a pair of eye modules.

The present invention has solved the problem of providing sleeping eyes in a doll having a soft head by constructing the soft head with a unitary core made of soft material, such as plastic foam or foam rubber, and embedding the sleeping eye modules in cavities in the core. The fabric used to cover the core and upon which the face of the doll is painted or otherwise applied is connected to each sleeping eye module either directly or through the intermediary of a member that locks the two eyes into the proper position relative to each other.

In a preferred embodiment of the invention, the intermediate member takes the form of a mask, preferably made of plastic material or other light weight, rigid material, comprising a pair of eye module—retaining portions integral with and on opposite sides of a nose-shaped portion. The eye module—retaining portions have apertures for enabling the eye of an eye module to protrude therefrom and means cooperating with the eye modules to secure the eye modules in the retaining portions.

By means of the present invention, it is now possible to provide a soft doll with sleeping eyes while minimizing the danger of having the eyes becoming detached from the fabric used to form the head. In addition, the eyes of the soft doll of the present invention will stay in the proper relationship to each other. The soft doll of the present invention may be manufactured and assembled in a rapid and economical manner.

The present invention is illustrated in greater detail in terms of a preferred embodiment shown in the drawing, in which:

FIG. 1 is a front elevational view of the head of a soft doll according to the invention:

FIG. 2 is a view in section, along the line 2—2 shown in FIG. 1;

FIG. 3A is a partial view in section generally along line A-A of FIG. 2 to indicate the fabric surface only with the unitary core, eye module and mask removed;

FIG. 3B is a partial view similar to FIG. 3A but with the mask inserted, and

FIG. 4 is an exploded view, in perspective, of the eye modules and the mask used in the present invention.

With reference to the drawing, FIG. 1 shows the front of the head of a doll 1 having a fabric covering 3 on which is drawn the features of a nose and mouth and eyebrows. The doll 1 has a pair of eyes 4*a* which are known as "sleeping" eyes.

As most clearly seen in FIG. 2, the head of the doll 1 is made of a unitary core 2 of resilient plastic foam, foam rubber or similar, soft unitary material. Within the core 2 is a pair of cavities 2*a* designed to hold eye modules 4 in place.

Referring now to FIGS. 2 and 4, the eye modules 4 are snapped into a mask 5 having a pair of generally circular retainer portions 6 on either side of and integral with a nose portion 7. Each circular portion 6 has a central aperture 6*a* through which the eye 4*a* of eye module 4 protrudes. For added realism, the eye module 4 is provided with eyelashes 4*b* on the eye portion 4*a*.

The mask 5 also includes a pair of lugs 8 that insert into corresponding notches 9 in the back portion 4*c* of the eye modules 4. The mask 5 also has a circular rib 10 (FIG. 2) that mates with a corresponding circular groove 11 (FIGS. 2 and 4) in the eye modules 4.

As is conventional, each eye module 4 includes a shaft 12 on which the eye 4*a* is pivotally mounted, the end of the eye 4*a* terminating in a counterweight 13. It can readily be seen that when the doll 1 is moved backward to a horizontal position the counterweight 13 will rotate to keep the eye 4*a* in the position shown in FIG. 2 so that the eye 4*a* and eyelash 4*b* will rotate relative to the doll's head to simulate the opening of the eye 4*a*.

The eye modules 4 are held in place in the head of the doll as follows. First, each module 4 is located within a cavity 2*a* in the core 2. This, in and of itself, minimizes the degree of movement of each of the eye modules 4. The use of the lug 8 and notch 9 restricts rotation of each module 4 about its longitudinal axis.

In addition, the fabric 3 is cut out to form the opening for the eye modules 4 as shown in FIG. 3A by means of a plurality of tongues 14. The tongues 14 are then pushed through aperture 6*a*, folded against the back of the mask 5 and then glued or otherwise attached to the back of circular portion 6 of the mask 5 as shown in FIG. 3B. In addition, the rib 10 and groove 11 assure that the eye modules 4 are firmly held in place in the mask 5 and this, coupled with the attachment of the mask 5 to the fabric 3, provides a rigid, stable structure insuring that each of the eye modules 4 will be held inside the head of the doll 1 in proper esthetic relationship to each other.

Manufacture of the doll 1 is accomplished as follows. First, a unitary core 2 is provided, as by molding or the like, to have the pair of cavities 2*a*. The mask 5 is then glued to the tongues 15 of the fabric 3 and the eye modules 4 snapped into place. The eye modules 4, while attached to the mask 5, are inserted into the cavities 2*a* and the fabric 3 wrapped around the core 2 to complete the head of the doll 1. Preferably the eye modules 4 are glued inside cavities 2*a*.

I claim:

1. A soft doll head having sleeping eyes and comprising a soft, resilient, unitary core of substantially the shape of a doll head having a pair of spaced, longitudinally extending cavities therein arranged with their longitudinal axes in parallel, an elongated sleeping eye module in each cavity with the movable eye thereof facing outwardly, an outer covering enclosing said core onto which the features of a doll face can be applied, said outer covering having a pair of eye holes in registry with said eyes, and intermediary means between said core and said outer covering for securing said eye modules in place relative to each other, said intermediary means comprising a pair of annular members secured to said outer covering, said annular members and said eye modules having cooperating means for securing said eye modules in said annular members with the movable eyes of said eye members protruding through the openings of said annular members and the annular members being on either side of and integral with a nose portion, said members and nose portion forming a mask means, wherein said eyeholes are formed by cutting a plurality of tongue portions in said outer covering and folding said tongue portions under said outer covering, said tongues being secured to said annular members of said mask means.

2. The doll head according to claim 1, wherein said annular members and said eye modules have cooperating means for preventing rotation of said eye modules about their longitudinal axes.

3. The doll head according to claim 2, wherein said cooperating means are a circular rib and a circular groove for receiving said circular rib.

4. The doll head according to claim 2, wherein said cooperating means is a lug and a notch for receiving said lug.

5. The doll head according to claim 4, wherein said core is made of foam rubber or of plastic foam and said outer covering is fabric.

* * * * *